United States Patent [19]

Nelson

[11] 3,934,660

[45] Jan. 27, 1976

[54] FLEXPOWER DEEP WELL DRILL

[76] Inventor: Daniel E. Nelson, 4875 Sand Lake Road, Orlando, Fla. 32809

[22] Filed: July 2, 1974

[21] Appl. No.: 485,231

[52] U.S. Cl. ..... 175/102; 175/267

[51] Int. Cl.[2] ..... E21B 3/08; E21B 9/32

[58] Field of Search ..... 175/106, 102, 97, 202, 175/203, 220, 319, 267, 269, 170

[56] References Cited

UNITED STATES PATENTS

| | | | |
|---|---|---|---|
| 1,072,964 | 9/1913 | Maher et al. | 175/102 |
| 1,287,477 | 12/1918 | Simpson | 175/106 |
| 1,841,302 | 1/1932 | Simmons | 175/106 X |
| 1,880,214 | 10/1932 | Simmons | 175/102 |
| 2,013,070 | 9/1935 | Sheridan | 175/106 X |
| 2,863,641 | 12/1958 | Kammerer | 175/267 |
| 2,915,288 | 12/1959 | Crapez | 175/102 |
| 3,077,234 | 2/1963 | Christian | 175/106 X |
| 3,232,361 | 2/1966 | Haspert | 175/102 |
| 3,381,766 | 5/1968 | Bannister | 175/106 |
| 3,513,657 | 5/1970 | Nelson et al. | 74/57 X |

FOREIGN PATENTS OR APPLICATIONS

| | | | |
|---|---|---|---|
| 1,167,285 | 4/1964 | Germany | 175/203 |

*Primary Examiner*—Price C. Faw, Jr.

[57] ABSTRACT

This is a deep well drill employing a Nelson air motor, a Nelson engine or other air motor for drilling power at the face of a petroleum or other deep well and having a cable and tube attached thereto and suspended from spools on a drill rig. A cutting container is attached to the drill to remove cuttings without mud. Drills for varying types of rock strata are provided. A type of foldable casing employed permits the use of the same diameter casing throughout the entire well of any depth, including deep wells to over 25,000 feet. Expandable bits at the end of the cable are provided for drilling selectively larger diameters for foldable casing walls and for safety valve and flow control anchors. The bits are also contractable for unobstructed travel up and down the well.

16 Claims, 16 Drawing Figures

FIG 1
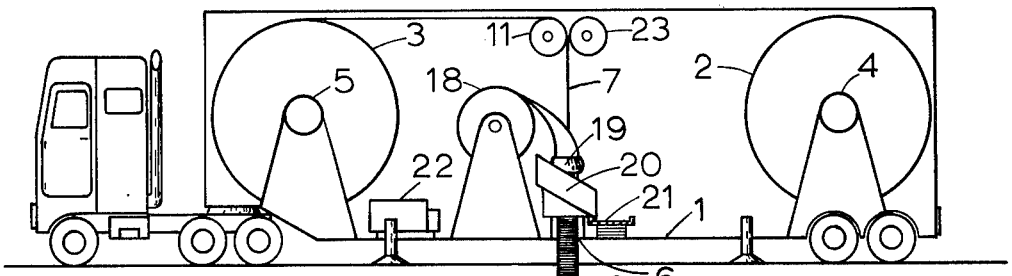
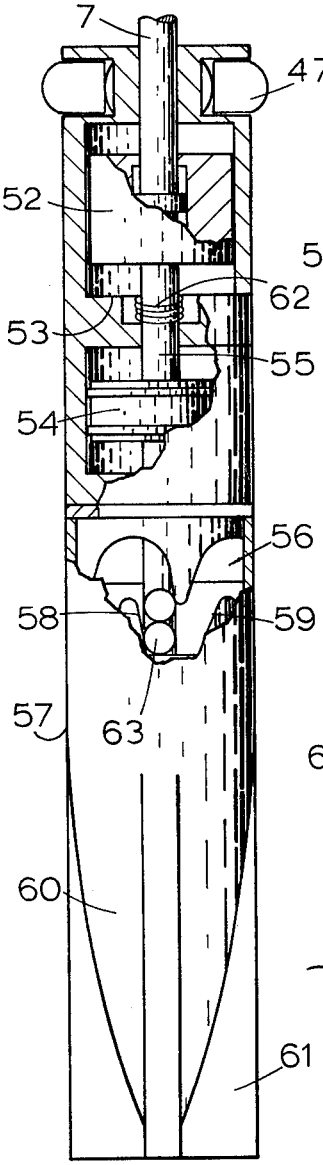
FIG 5
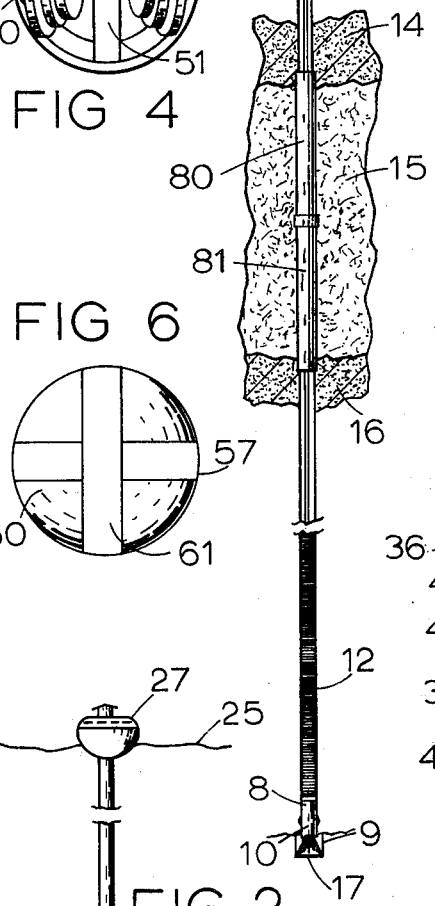
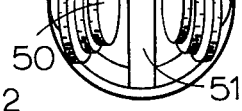
FIG 4
FIG 6
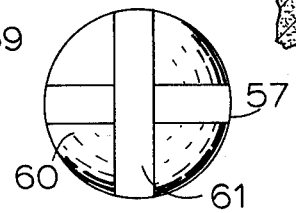
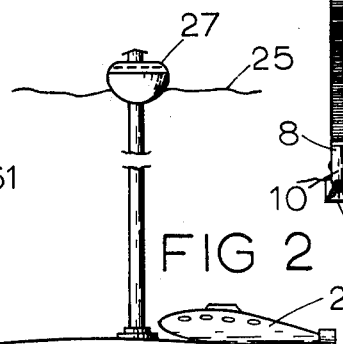
FIG 2
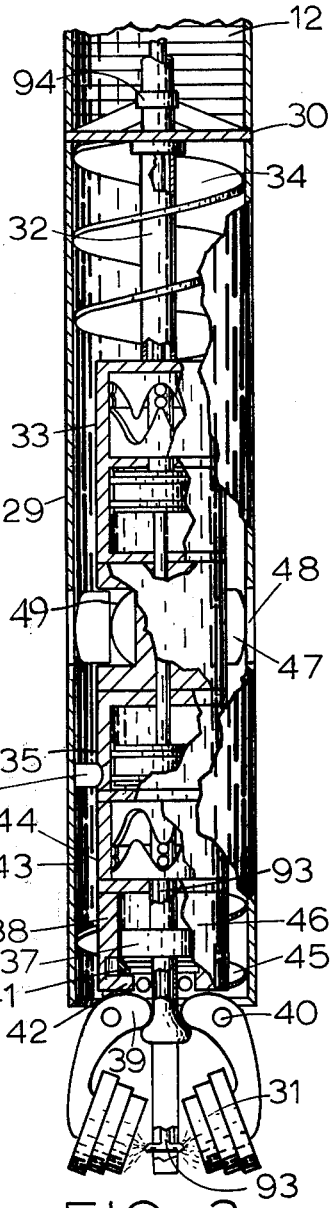
FIG 3
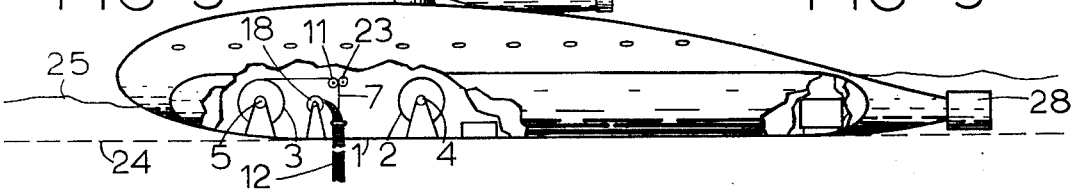

18
77

76
75
72
72
74
77
73

88
86
87
72
74
75

84
85
72

76
90
92
91
89

80
19
20
82
83

70
64
69
68
66
65
67
71
12
21
78

81
79
20
21

FLEXPOWER DEEP WELL DRILL

BACKGROUND OF THE INVENTION

Rotary drills to date have used largely the rotary stem principle with a rotary drill at the end of a stem extended to the face of the well being drilled. Another type of rotary drill has been the use of the stem but without rotating it. Rather than rotating the stem there has been the practice of forcing mud down through the stem to turn a mud motor which drills at the bottom. The chips, or cuttings, are circulated back up the outside of the stem. In the rotary stem approach mud is also used to carry the chips up the outside of the stem after the mud is forced down through the center of the stem. The mud also acts as a coolant in both cases.

In both of these practices the time and cost of changing bits by bringing up the drill stem piece-by-piece and then putting it back in after changing the bit in the reverse piece-by-piece process is immense. Ordinarily it consumes approximately 90% of the time, ranging from 50% up to 98%, depending on the depth of the well. The deeper the well, the higher percentage of time it takes to change bits. Time, of course, is cost because it is both labor and equipment being utilized over a period of time.

The costs of preparing, supplying and processing the mud as it is used are also extremely expensive. The cost of power to turn the drill is extremely high also, owing to the friction of the mud and the extremely heavy drill stem.

Only about 10% of power actually used in the drilling process is required for the cutting action separate and apart from other power requirements of turning the drill stem. This is not diminished appreciably by the mud power motor drill because of the high friction of mud being pressured in and out of the drill stem. Cable drilling that has been practiced to date is a bounce power system. The bit at the bottom of the well is bounced to give a jack-hammer effect with non-cutting rotation. This is a good drilling system for some purposes, but it is highly ineffective for deep drilling.

The instant invention utilizes a cable but in a far different manner. It is utilized as a method of suspending a power system rather than a method of moving a drilling mechanism directly. The cable is a conveyance means rather than a power transfer means in this invention.

Objects and distinguishing features of this invention are that it provides a method of changing bits that consumes no more than 10% of the time and as little as 2% of the time of present drill stem drilling systems, whether they are rotary drill stem or mud drilling motor systems. It provides a total rig cost system that is approximately 10% or less of present rig equipment cost systems for equal depth capacity. It provides a drilling system which requires less than one third the labor cost per time of drilling, thus making the total labor cost average between 3–10% of present labor drilling costs.

Another objective is to provide a means of drilling without changing hole diameters throughout an entire 25,000 feet or more of well drilling. The outset and the final hole diameter can be approximately eight inches for optimum drilling to any depth.

Another object is to provide a casing system with a capability of being used only at the strata where casing is needed rather than at entire hole lengths or depths just to case certain required sections.

Another objective is to provide a drilling system that can be portable on a truck for drilling up to 25,000 feet with the equipment carried on one semi-trailer truck.

Another objective is to provide a system that allows drilling from the ocean bottom or from the surface of the ocean with the same proportional advantages over present offshore or ocean drilling as the portable semi-trailer rig has over the land drilling conventional systems.

BRIEF DESCRIPTION OF DRAWINGS

FIG. 1 is a side view of a drilling platform in which a truck trailer is used as a drilling platform.

FIG. 2 is a cut-away side view of a ship with ocean surface and ocean floor operability and with ice cutter front section being employed as a drilling platform.

FIG. 3 is a side view cut-away drawing of a drill guide with drill bit, motor, auger and other drilling members included therein.

FIG. 4 is an end view of a drill bit showng a combination of a rotary bit and a bladed bit.

FIG. 5 is a side view cut-away of a jackhammer drill head used for certain types of soft strata.

FIG. 6 is an end view of the jackhammer bit shown in FIG. 5.

FIG. 7 is a side view cut-away of a jackhammer centrally positioned within a collector sleeve.

FIG. 8 is a side view cut-away of a sock spool onto which a cutting collector sleeve is flattened and wound after the cuttings or chips are removed from it.

FIG. 9 is a top view of the sock in progressive unfolding condition.

FIG. 10 is a cross section of the sock ribs showing double hooks to hold the sock together when in use but to allow its unhooking for flattened condition when wound around the spool.

FIG. 11 is a cross section end view of the ribs in locked position.

FIG. 12 is a top view of a cutting catcher with an orifice for passing the sock and cable through.

FIG. 13 is a side view cut-away of an expandable casing.

FIG. 14 is a top view of the expandable casing locked in folded position by an explosive bolt or other fastening device.

FIG. 15 is determines double or rachet hook section of the expandable casing in unfolded and locked position.

FIG. 16 is an end view of a hollow cable used to transport pressurized media down to the drill motor, to transport the media back to the surface and to transport electrical or other control medial and cooling water or other fluid to the drill.

CONSTRUCTION AND OPERATION

Figures 7, 8, 9, 10, 11, 12, 13, 14, 15, 16:
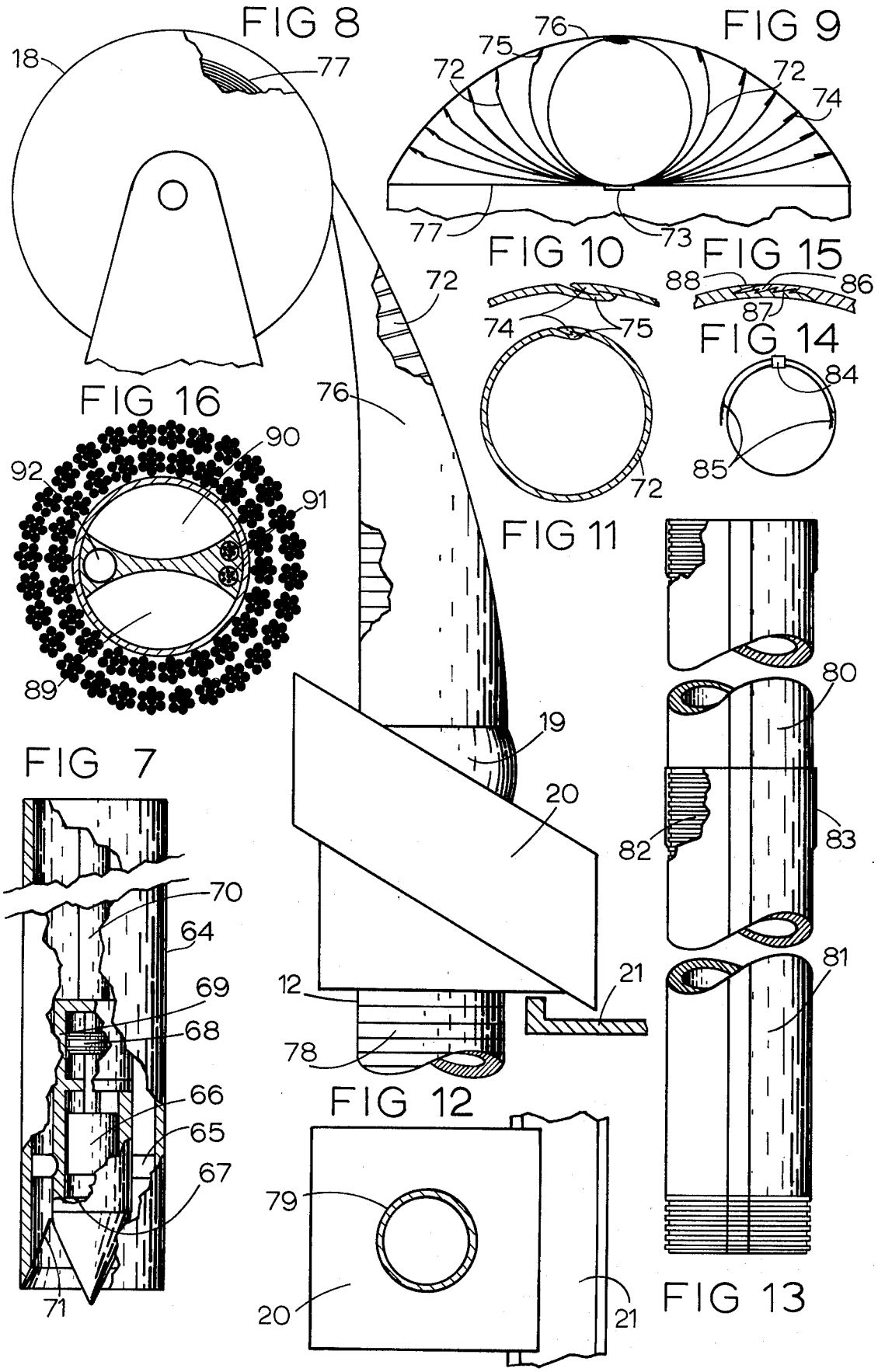

The construction and operation of this invention are described in accompanying drawings as follows:

Referring to FIG. 1, a drilling platform 1 is provided as a truck trailer, ship, or other portable or non-portable structure. An upper level cable spool 2 and a lower level cable spool 3 are positioned on axis 4 and 5 respectively at opposite sides of platform drill orifice 6. Hollow cable 7 is wound around each spool The hollow cable has multiple functions. It is used to lower and raise a drill head 8 in and out of a well 9. It is used to convey air or other gas to a drill motor 10 and to return air, exhaust or other gas from the drill motor. Electricity for operating controls at the drill head and water for cooling the drill bit can also be channeled through the cable. A major function of the cable is to bring up cuttings from the well. It is also used to lower and place expandable diameter casing in the well at rock strata requiring casing without casing the remainder of the well.

The cable is shown in FIG. 1 as extended from the platform around a pulley 11; through a cutting sock 12; through an emergency underground remote control shutoff valve 13; through upper sealing strata rock 14; through casing required strata 15; through lower sealing strata rock 16; and finally to the drill head at the well face 17.

The cutting sock is shown in FIG. 1 where it is partially wound around a sock spool 18 in the process of being unhooked from a cylindrical condition at a sock fastener 19 and spread in a flat condition to be wound around the sock spool. The fastening and winding is a reversible process.

The sock is caused to receive the cuttings above the drill head and to contain them for being removed from the well without friction of the cuttings against the walls of the well. Cuttings from the sock are collected on a cutting catcher 20 over which the cuttings are transferred to a cutting conveyor 21 to be removed and analyzed.

The spools are turned by a motor or prime mover 22 with an appropriate power train between the power source and the spools. The platform vehicle engine can also be used for this purpose. A Nelson air motor and compressor combination are recommended for this purpose.

A second pulley 23 is provided for use with the lower level cable spool and also as a clamp means for holding cable from one spool while it is being connected or disconnected to cable from the other spool.

The cable can be graduated in diameter and strength for different levels and corresponding weights to be held by the cable. The cable on the lower level spool can also be smaller in diameter than the cable on the upper level spool.

Regardless of how the cable is varied in thickness or whether it is of uniform size, the average footage for each cable spool with an average appropriate 2¼ inch diameter hollow cable is 12,500 feet. This allows a total drilling depth capability of 25,000 feet for a drilling platform and all equipment and supplies to be transportable on a single semi truck trailer.

Referring to FIG. 2, the drilling platform can be a ship or submarine or a marine vessel capable of being used as a platform either at the ocean bottom 24 or at the surface of the ocean 25. A vessel with both bottom and surface of the ocean capability and also with ice-cutting formation is illustrated. Included with this marine vessel are a commuter vessel 26, an air supply buoy 27, the mechanisms shown in FIG. 1, and the propulsion system 28 for the vessel. A Nelson engine, U.S. Pat. No. 3,570,463, is recommended for the propulsion system and for all purposes.

Referring to FIG. 3, a drill guide 29 is extended from the bottom end of the cable and sock at a cable and sock attachment 30 to a bit 31.

Air or other gas is directed from the cable through an auger axis 32 and then to an auger motor 33 that rotates an upper auger 34 to cause cuttings from the well face to be conveyed into the cutting sock and removed from the well therein.

The air or other gas, or a portion thereof, is further directed from the auger motor shaft to a drill motor 35 which is employed to turn the drill bit.

The auger motor and the drill motor can either or both be Nelson engines, referred to above, or Nelson air motors, U.S. Pat. No. 3,513,657, or other appropriate electric or hydraulic motors or engines. The drill motor can also be any mode or combination of modes of Nelson excavator engines described in U.S. Pat. No. 3,489,230.

Variable extension of the bit cutter members radially outward at right angles to the axis of the drill sleeve causes cutting at diameter dimensions determined by the extent out of such extension. The farther outwardly they are extended the larger diameter they are caused to cut. The cutting members can also be withdrawn inwardly to where they can be moved readily up and down the well for changing bits and for cutting removal.

There are three main diameter dimensions at which the cutters are to be positioned. One is a diameter slightly smaller than the well diameter cut. This small diameter position is for moving the bit up and down the well without interference with the walls of the well.

The next diameter is slightly larger than the diameter of the drill sleeve. This is the diameter that the bit will be set to cut the main portion of the well. It should be a sufficiently large diameter to allow free passage of the sleeve within the well diameter cut by the bit. This cutting diameter should not be great enough to allow the sleeve to slant within the well and thus result in directional drilling that is not desired.

The third extension variation is a wide enough diameter to receive the thickness of expandable diameter casing wall to be inserted in strata requiring casing. It is also a diameter great enough to allow for slanting of the sleeve for desired directional drilling in a controlled manner by varying the cutting angle of the drill motor with attachment arms 36.

The drill cutter members can be extended or withdrawn in diameter by pressure actuation of a bit control piston 37. Air or other gas pressurized against the upper side of the bit control piston causes it to travel downward in bit control cylinder 38 and thus to move cutter lever arms 39 downwardly with a resulting outward movement effect on the cutters which are pivotably attached to cutter axis 40 in a lever-fulcrum relationship.

The extent to which the piston is moved downwardly can be controlled by the insertion or removal of control stoppers 41 placed between the bottom side of the control piston head and the bottom cylinder head 42. The stopper has a graduated thickness such that the farther in it is inserted when the control piston is up, the smaller the diameter will be when the piston is forced to the bottom of its travel. The downward travel is restricted by the stopper selectively, therefore, to control the cutting diameter.

Actuation of the motor attachment arms, the stopper, and the piston can either or all be accomplished using electrical solenoid practices. Electrical current for actuation of these and other controls can be supplied and remote control can be applied from the drilling platform by conventional electrical control practices through electrical cable within the hollow drill cable.

Cuttings are conveyed upwardly between the inside diameter of the drill guide 43 and the outside diameter of the drill motor 44 by lower auger 45 attached to the rotational section 46 of the drill motor. Cuttings are conveyed upwardly into the cutting sock by the upper auger.

Transverse rotation of the drill guide in opposing reaction to the rotation of the drill motor and bit is arrested by transverse cutters 47 which are extendable from inside the drill guide through transverse cutter slots 48 as caused by pressure from a transverse spring 49 or by gas pressure or electrical operation. The transverse cutters are provided with slanting leading and trailing edges to cause them to be pushed inwardly by hard rock strata and yet cut a groove sufficiently deep to resist reactionary rotational movement of the guide. They can also be made broad and long enough and extendable widely enough to arrest sleeve rotation in sand drilling strata.

Referring to FIG. 4, the cutters can be either wheel type 50 or blade type 51 or both as shown by this bottom view of the sleeve and bit. One advantage of using both wheel and blade together is the increased ability to drill through varying strata conditions without changing the bit for the different kinds of strata. Another advantage is that efficient and rapid cutting can be accomplished not only by having the advantages of both types of cutters but also by a synergistic effect achieved by the conditioning of the well face advantageously by each type of bit for the other type following it. Still a fourth advantage is an improved jackhammer effect that can be accomplished with the blade-type bit from the vertically reciprocating action that can be achieved to the extent desired by the Nelson air motor or Nelson engine employed as the drill motor. The jackhammer effect can be advantageous to both types of cutters but more advantageously to the blade type.

Referring to FIG. 5, a drill head with a greater jackhammer effect is provided with hammer 52 actuated against anvil 53 by reciprocating travel of jackhammer motor piston 54. Air or other gas is conveyed from the hollow drill cable to jackhammer shaft 55 and through the hammer to the piston where it is either used in combustion for engine mode or used to pressurize the piston in air motor mode at alternately opposite sides of the jackhammer motor piston.

The cam groove 56, as described in the patents referred to above for the Nelson engine and for the Nelson air motor, is made relatively or totally vertical for downward travel of the piston and hammer for maximum input velocity when the hammer strikes the anvil at the bottom of each stroke. Turning of a bit section 57 is caused during upward travel of the piston by inclined sections of the cam drive groove. Vertical sections are indicated by 58 and inclined sections by 59.

Drill sleeve and transverse cutters are provided substantially as for the rotary cutter described in relation to FIG. 3.

The cutter section of the jackhammer bit is provided with a cone section 60 and blades 61 extended radially therefrom.

Referring to FIG. 6, an end view of the jackhammer bit shows the blades extended from the cone section to form cutters the full diameter of the sleeve or sufficiently farther to allow free passage of the drill head through the well or for passage of cuttings past the drill head.

There may or may not be cutting retrieval for the jackhammer drill head. This drill head can be used in strata where it is feasible and more advantageous to force the drill head through the strata without removing cuttings. It can also be used with a small sleeve diameter such that cuttings are removed for the mode described for FIG. 3.

A vertical spring attachment 62 is provided between the shafts connecting the hammer and the jackhammer actuation piston. This allows travel of the drive teeth 63 beyond the stopping point caused by the anvil for simultaneous rotary motion of the drill and reciprocating travel of the hammer in striking action against the anvil.

Referring to FIG. 7, a sleeve-type jackhammer drill head is provided with a guide 64 and a concentrically positioned jackhammer attached to the sleeve by radially extended flat spoke mounts 65. The jackhammer is provided with a hammer 66, an anvil 67, an actuation piston 68 in cylinder 69 and a compressed air or other gas supply 70 from the cable spool terminal end of the hollow cable.

The cutting sock is attached for receiving cuttings for removal the same as for the modes of the device described for FIG. 3 and FIG. 5.

Jackhammer effect is transferred to the sleeve and to the centrally positioned jackhammer to force them thereby into the strata being drilled. This mode is more favorable for beginning a hole and for drilling through sand than for hard rock drilling.

A one-way valve 71 is provided to prevent return of the sand when the bit is removed with the cuttings being retained in the sock above the drill head. A similar appropriate valve or retainer is provided for the other modes of the invention.

Referring to FIG. 8, the cutting sock is shown in winding or unwinding process around the sock spool. In a winding process, cuttings would be collected on the cutting catcher for transfer by the cutting conveyor after the sock were unfastened by the sock fastener. In unwinding process, the sock would be unwinding from the sock and passing downward through the sock fastener. This unwinding would change the sock from a flat condition to a cylindrical container.

The sock is comprised of a series of flat spring ribs 72, preferably metal, joined at the outside and center of each to a back spring 73. They may also be joined by interlocking sections of each rib, not illustrated.

The ribs are hooked together by inward hooks 74 and outward hooks 75. These hooks are caused to engage each other by bringing the ends together by graduated fastener section 76 originating in a flat condition 77 near the sock spool and terminating in a circular section 78. The ribs are caused to take the graduated shape of the fastener by being passed over it downwardly and then through it at the circular section.

Fastening is achieved by bringing the ends to an overlapping condition and then allowing them to expand. This engages mating hooks at each end.

Unfastening is achieved by the reverse action of fastening. The hook ends are allowed to expand to a straightening condition without hook engagement for unfastening. The hooks are guided to an engaging relationship after reaching an overlap condition for hooking to form the sock into a ribbed cylindrical container.

The cutting catcher is a slanted table positioned below the fastener. It is provided with a catcher orifice 79 through which the sock passes for catching cuttings after it is unfastened when the sock passes through it in upward travel. The cable also passes through the catcher orifice.

Referring to FIG. 9, the sock spring rib 72 sections are shown in an unfolding attitude from a circular position at the fastener circular section 78 and progressively to a flat section 77 which terminates at the outside diameter of the sock spool 18. The back spring 73 is shown attached to the outside of the ribs. This is a top view of the fastening-unfastening physical relationship of the parts between the fastener and the sock spool.

Referring to FIG. 10, double hooks of the sock ribs are shown in an exploded sectional view in a locked position.

Referring to FIG. 11, an entire locked rib section is shown in a top view.

Referring to FIG. 12, a top view of the cutting catcher is shown with the sock and cable passing through its orifice vertically.

Referring to FIG. 13, two expandable casing sections 80 and 81 are shown connected with tongues and grooves 82 at joining section 83.

Referring to FIG. 14, an end view of a casing is shown locked in folded position by explosive lock bolt 84. In this position, double hook wall ends 85 of the casing are overlapped to an extent that the casing is in what is referred to as a folded condition. When the lock bolt is released, the casing expands from its folded position by its own outward spring tension to where the double hooks are engaged and the ends are only partially overlapped.

Referring to FIG. 15, the double hooks are shown in an exploded section view with lock hooks 86 and 87 to prevent unlocking of the hooks from inward pressure against the outside of the casing from liquids, gases or cave-in material in the hole.

The casing can be relatively light or thin walled in comparison to present casing. This wall thinness facilitates the ease of folding the casing to a locked position. The thinness is possible because there is relatively little casing with resulting casing support weight required, owning to the necessity of casing only sand or overly porous, or objectionable fluid sections of the well. Almost all of the rock strata in most wells and all of the rock strata in some wells can be left uncased either for production or further drilling purposes.

The underground shutoff 13 is anchored to a thick wall flanged pipe 88 that is entended towards the surface, to obviate the need for connecting a shutoff valve to a longer string of casing. The flange can be mostly cement that is poured into an increased diameter undercut section that is drilled by using the expandable drilling capability of the drill bit.

The expandable casing is employed to provide the capability of uniform hole diameter from the underground shutoff depth of approximately fifty feet down to any depth drilled. This reduces drilling costs further by not requiring large diameter drilling at the outset, followed by telescoped smaller diameters at lower depths. It decreases the need for duplicity of drilling heads and bits for different diameter drilling. It also facilitates equipment entry into the well by elimination of step sections.

Referring to FIG. 16, the hollow cable 7 can consist of an inlet conduit 89, outlet conduit 90, electrical control card 91, cooling water conduit 92 and such other conduits as needed. Terminal input and outlet of the cable channels can be provided by appropriate revolving connections at the axis of the cable spools.

The conduits can also be separate from the cable to wind on a separate spool. This allows for a smaller diameter of cable such that the entire 25,000 feet for an all-purpose drilling unit can be wound onto one spool. But the conduits, preferably in one combined strand, would require the other spool such that the total machinery requirement remains relatively constant. The separate cable and conduit system can be less expensively and more rapidly produced but short lived. The long-range costs and ease of operation factors would favor the integrated cable and conduit section as illustrated.

Cooling of the cutting blades can be achieved for longer bit life by the transfer of water to the blades from a platform supply source to the blades through the water conduit. Appropriate engine bypass water conduit 93 is provided between the cable connection 94 (FIG. III) and the bit.

The extensive time and cost for separate core drilling for testing strata characteristics and determining the presence or probability of oil is not necessary. A core type sampling far better than present coring samples is provided continuously by the immensely rapid drilling and cutting removal of this drilling system.

A total drilling system has thus been described.

What is claimed is:

1. A well-drilling device having a drill motor, a drill bit attached to a drive shaft of the motor in rotatable contact with the housing of the motor, a drill guide from which the bit is extended in contact therewith from the bottom end thereof, a cable attached to the guide, a hydraulic supply line attached at one end to the motor in inlet port relationship therewith and attached at the other end to a fluid supply source, a cable spool onto which the cable can be wound and unwound to allow the drill guide and bit assembly to be raised and lowered respectively, and an exhaust return conduit attached to the motor in outlet port relationship therewith.

2. A well-drilling device as described in claim 1 and having a Nelson air motor as the drill motor.

3. A well drilling device as described in claim 1 and having a hollow cylindrical cutting sock in cutting receiving relationship to the upper end of the drill guide, a sock fastening and unfastening means parallel to the axis of the sock, a cutting conveyance means, and an emptied sock holder.

4. A well drilling device as described in claim 1 and having conduits attached to the said cable appropriately for conveying various required fluids and electricity.

5. A well-drilling device as described in claim 1 and having transverse cutters radially extendable from the drill guide appropriately for pressure penetration into the well walls to arrest transverse action of the drill guide in opposing reaction to rotary motion of the drill motor and drill bit.

6. A well-drilling device as described in claim 1 and having a Nelson excavator, U.S. Pat. No. 3,489,230, as the drill motor.

7. A well-drilling device as described in claim 1 and having an electrical motor as the drill motor.

8. A well-drilling device having a drill motor, a drill bit attached to a drive shaft of the motor in rotatable contact with the housing of the motor, a drill guide from which the bit is extended in contact therewith from the bottom end thereof, a cable attached to the guide, a cable spool onto which the cable can be wound and unwound to allow the drill guide and bit assembly to be raised and lowered respectively, a hollow cylindrical cutting sock in cutting receiving relationship to the upper end of the drill guide, a sock fastening and unfastening means parallel to the axis of the sock, a cutting conveyance means, an emptied sock holder, conduits attached to the cable appropriately for conveying various required fluids and electrical current, transverse cutters extendable radially from the drill guide in opposing reaction to rotary motion of the drill motor and drill bit, an expandable cutting diameter bit with attachment arms pivotably attached to the drive shaft of the drill motor, and a bit cutting diameter control piston with a shaft extended therefrom in lever arm actuation relationship to cutters of the bit in expandable and contractable working relationship therewith.

9. A well-drilling device as described in claim 8 and having bit cutting diameter control piston stoppers with graduated thickness selectively insertable between the control piston head and a restriction abutment head appropriately to cause the bit to cut at larger diameters to the extent of insertion of the said stoppers.

10. A well-drilling device as described in claim 9 and having a stopper setting for a bit cutting diameter approximately six inches larger than the diameter of the drill guide, a stopper setting for a bit cutting diameter approximately 2 inches larger than the diameter of the drill guide, a stopper setting for a bit cutting diameter approximately one quarter of an inch larger than the diameter of the drill guide, and a stopper setting for a bit cutting diameter approximately 1/32 of an inch larger than the diameter of the drill guide.

11. A well-drilling device as described in claim 10 and having a remote control safety valve positioned in an undercut large cemented diameter section of rock beneath ground appropriate to contain oil or gas well blowouts and to shut off their flow in the event of fire in the hole, and a thick wall pipe attached to the cemented section and extended to the surface for surface valve and control attachments.

12. A well-drilling device as described in claim 10 and having an auger screw positioned in rotatable relationship with the inside of the drill guide, and an auger motor in rotary power transfer relationship to the auger screw.

13. A well-drilling device as described in claim 10 and having axial open and foldable casing in interlocking attachable lengths insertable into the well and caused to unfold and lock in full diameter large enough to allow passage of the drill bit and guide therethrough at drill strata requiring casing where well diameter cuts have been large enough to allow for the foldable casing wall thickness in the said strata and in sealing rock above and below said strata.

14. A well-drilling device as described in claim 13 and having a portable rig drilling platform onto which the machinery is mounted and from which the drill bit assembly is suspended with the cable for drilling.

15. A well-drilling device as described in claim 14 and having a wheeled vehicle as the portable platform.

16. A well-drilling device as described in claim 14 and having a marine vehicle as the portable platform.

* * * * *